US007617651B2

(12) United States Patent
Grafenauer

(10) Patent No.: US 7,617,651 B2
(45) Date of Patent: Nov. 17, 2009

(54) FLOOR PANEL

(75) Inventor: Thomas Grafenauer, Onzour sur Loire (FR)

(73) Assignee: Kronotec AG, Luzern (CH)

( * ) Notice: Subject to any disclaimer, the term of this patent is extended or adjusted under 35 U.S.C. 154(b) by 886 days.

(21) Appl. No.: 10/697,567

(22) Filed: Oct. 31, 2003

(65) Prior Publication Data

US 2004/0123547 A1 Jul. 1, 2004

(30) Foreign Application Priority Data

Nov. 12, 2002 (DE) ..... 102 52 864

(51) Int. Cl.
*E04B 2/00* (2006.01)

(52) U.S. Cl. ..... 52/592.1

(58) Field of Classification Search ..... 52/592.1
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |

(Continued)

FOREIGN PATENT DOCUMENTS

| | | |
|---|---|---|
| AT | 005566 | 8/2002 |

(Continued)

OTHER PUBLICATIONS

Webster Dictionary, p. 862.

(Continued)

*Primary Examiner*—Richard E Chilcot, Jr.
*Assistant Examiner*—Jessica Laux
(74) *Attorney, Agent, or Firm*—Greenblum & Bernstein P.L.C.

(57) ABSTRACT

Floor panel which is bounded in a horizontal plane by a top side, which is provided with a decorative layer or the like, and an underside, which is provided for bearing on an underlying surface, the floor panel being provided with means for the releasable connection of at least two panels, it being the case that the connecting means are formed on at least one first side edge such that locking takes place in the transverse direction (Q) and vertical direction (V), that form-fitting elements for locking in the vertical direction (V) with a further panel are formed on a second side edge, which runs at an angle to the first side edge, that the form-fitting elements are spaced apart from one another in the transverse direction (Q) and in the vertical direction (V) on two spaced-apart, essentially vertically oriented walls, in which case a tongue is formed on the first side edge, the tongue extending in the longitudinal direction of the side edge, and a recess, corresponding to the tongue, is formed on an opposite side edge, the underside of the tongue, starting from the tip of the tongue, having a continuously curved contour.

8 Claims, 3 Drawing Sheets

U.S. PATENT DOCUMENTS

| | | | | |
|---|---|---|---|---|
| 1,575,821 | A | | 3/1926 | Daniels |
| 1,602,256 | A | | 10/1926 | Sellin |
| 1,602,267 | A | | 10/1926 | Karwisch |
| 1,615,096 | A | | 1/1927 | Meyers |
| 1,622,103 | A | | 3/1927 | Fulton |
| 1,622,104 | A | | 3/1927 | Fulton |
| 1,637,634 | A | | 8/1927 | Carter |
| 1,644,710 | A | | 10/1927 | Crooks |
| 1,660,480 | A | | 2/1928 | Daniels |
| 1,714,738 | A | | 5/1929 | Smith |
| 1,718,702 | A | | 6/1929 | Pfiester |
| 1,734,826 | A | | 11/1929 | Pick |
| 1,764,331 | A | | 6/1930 | Moratz |
| 1,776,188 | A | | 9/1930 | Langb'aum |
| 1,778,069 | A | | 10/1930 | Fetz |
| 1,779,729 | A | | 10/1930 | Bruce |
| 1,787,027 | A | | 12/1930 | Wasleff |
| 1,823,039 | A | | 9/1931 | Gruner |
| 1,859,667 | A | | 5/1932 | Gruner |
| 1,898,364 | A | | 2/1933 | Gynn |
| 1,906,411 | A | | 2/1933 | Potvin |
| 1,921,164 | A | | 8/1933 | Lewis |
| 1,929,871 | A | | 10/1933 | Jones |
| 1,940,377 | A | | 12/1933 | Storm |
| 1,946,648 | A | | 2/1934 | Taylor |
| 1,953,306 | A | | 4/1934 | Moratz |
| 1,986,739 | A | | 1/1935 | Mitte |
| 1,988,201 | A | | 1/1935 | Hall |
| 2,023,066 | A | | 12/1935 | Curtis et al. |
| 2,044,216 | A | | 6/1936 | Klages |
| 2,065,525 | A | | 12/1936 | Hamilton |
| 2,123,409 | A | | 7/1938 | Elmendorf |
| 2,220,606 | A | | 11/1940 | Malarkey et al. |
| 2,276,071 | A | | 3/1942 | Scull |
| 2,280,071 | A | | 4/1942 | Hamilton |
| 2,324,628 | A | | 7/1943 | Kähr |
| 2,328,051 | A | | 8/1943 | Bull |
| 2,398,632 | A | | 4/1946 | Frost et al. |
| 2,430,200 | A | | 11/1947 | Wilson |
| 2,740,167 | A | | 4/1956 | Rowley |
| 2,894,292 | A | | 7/1959 | Gramelspacker |
| 3,045,294 | A | | 7/1962 | Livezey, Jr. |
| 3,100,556 | A | | 8/1963 | De Ridder |
| 3,125,138 | A | | 3/1964 | Bolenbach |
| 3,182,769 | A | | 5/1965 | De Ridder |
| 3,203,149 | A | | 8/1965 | Soddy |
| 3,204,380 | A | | 9/1965 | Smith et al. |
| 3,267,630 | A | | 8/1966 | Omholt |
| 3,282,010 | A | | 11/1966 | King, Jr. |
| 3,310,919 | A | | 3/1967 | Bue et al. |
| 3,347,048 | A | | 10/1967 | Brown et al. |
| 3,460,304 | A | | 8/1969 | Braeuninger et al. |
| 3,481,810 | A | | 12/1969 | Waite |
| 3,526,420 | A | | 9/1970 | Brancaleone |
| 3,535,844 | A | * | 10/1970 | Glaros ..... 52/592.1 |
| 3,538,665 | A | | 11/1970 | Gohner |
| 3,553,919 | A | | 1/1971 | Omholt |
| 3,555,762 | A | | 1/1971 | Costanzo, Jr. |
| 3,608,258 | A | | 9/1971 | Spratt |
| 3,694,983 | A | | 10/1972 | Couqet |
| 3,714,747 | A | | 2/1973 | Curran |
| 3,720,027 | A | | 3/1973 | Christensen |
| 3,731,445 | A | | 5/1973 | Hoffmann et al. |
| 3,759,007 | A | | 9/1973 | Thiele |
| 3,760,548 | A | | 9/1973 | Sauer et al. |
| 3,768,846 | A | | 10/1973 | Hensley et al. |
| 3,859,000 | A | | 1/1975 | Webster |
| 3,878,030 | A | | 4/1975 | Cook |
| 3,902,293 | A | | 9/1975 | Witt et al. |
| 3,908,053 | A | | 9/1975 | Hettich |
| 3,936,551 | A | | 2/1976 | Elmendorf et al. |
| 3,988,187 | A | | 10/1976 | Witt et al. |
| 4,006,048 | A | | 2/1977 | Cannady, Jr. et al. |
| 4,090,338 | A | | 5/1978 | Bourgade |
| 4,091,136 | A | | 5/1978 | O'Brian et al. |
| 4,099,358 | A | | 7/1978 | Compaan |
| 4,118,533 | A | | 10/1978 | Hipchen et al. |
| 4,131,705 | A | | 12/1978 | Kubinsky |
| 4,164,832 | A | | 8/1979 | Van Zandt |
| 4,169,688 | A | | 10/1979 | Toshio |
| 4,242,390 | A | | 12/1980 | Nemeth |
| 4,243,716 | A | | 1/1981 | Kosaka et al. |
| 4,245,689 | A | | 1/1981 | Grard et al. |
| 4,246,310 | A | | 1/1981 | Hunt et al. |
| 4,290,248 | A | | 9/1981 | Kemerer et al. |
| 4,299,070 | A | | 11/1981 | Oltmanns et al. |
| 4,426,820 | A | | 1/1984 | Terbrack et al. |
| 4,431,044 | A | | 2/1984 | Bruneau |
| 4,471,012 | A | | 9/1984 | Maxwell |
| 4,501,102 | A | | 2/1985 | Knowles |
| 4,561,233 | A | | 12/1985 | Harter et al. |
| 4,585,685 | A | | 4/1986 | Forry et al. |
| 4,612,745 | A | | 9/1986 | Hovde |
| 4,641,469 | A | | 2/1987 | Wood |
| 4,653,242 | A | | 3/1987 | Ezard |
| 4,654,244 | A | | 3/1987 | Eckert et al. |
| 4,703,597 | A | | 11/1987 | Eggemar |
| 4,715,162 | A | | 12/1987 | Brightwell |
| 4,738,071 | A | | 4/1988 | Ezard |
| 4,752,497 | A | | 6/1988 | McConkey et al. |
| 4,769,963 | A | | 9/1988 | Meyerson |
| 4,819,932 | A | | 4/1989 | Trotter, Jr. |
| 4,831,806 | A | | 5/1989 | Niese et al. |
| 4,845,907 | A | | 7/1989 | Meek |
| 4,905,442 | A | | 3/1990 | Daniels |
| 4,947,602 | A | | 8/1990 | Pollasky |
| 5,029,425 | A | | 7/1991 | Bogataj |
| 5,103,614 | A | | 4/1992 | Kawaguchi et al. |
| 5,113,632 | A | | 5/1992 | Hanson |
| 5,117,603 | A | | 6/1992 | Weintraub |
| 5,136,823 | A | | 8/1992 | Pellegrino |
| 5,165,816 | A | | 11/1992 | Parasin |
| 5,179,812 | A | | 1/1993 | Hill |
| 5,205,091 | A | | 4/1993 | Brown |
| 5,216,861 | A | | 6/1993 | Meyerson |
| 5,251,996 | A | | 10/1993 | Hiller et al. |
| 5,253,464 | A | | 10/1993 | Nilsen |
| 5,283,102 | A | | 2/1994 | Sweet et al. |
| 5,295,341 | A | | 3/1994 | Kajiwara |
| 5,335,473 | A | | 8/1994 | Chase |
| 5,348,778 | A | | 9/1994 | Knipp et al. |
| 5,349,796 | A | | 9/1994 | Meyerson |
| 5,390,457 | A | | 2/1995 | Sjölander |
| 5,413,834 | A | | 5/1995 | Hunter et al. |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,567,497 | A | | 10/1996 | Zegler et al. |
| 5,570,554 | A | | 11/1996 | Searer |
| 5,597,024 | A | | 1/1997 | Bolyard et al. |
| 5,630,304 | A | | 5/1997 | Austin |
| 5,653,099 | A | | 8/1997 | MacKenzie |
| 5,671,575 | A | | 9/1997 | Wu |
| 5,694,734 | A | | 12/1997 | Cercone et al. |
| 5,706,621 | A | | 1/1998 | Pervan |
| 5,736,227 | A | | 4/1998 | Sweet et al. |
| 5,768,850 | A | | 6/1998 | Chen |
| 5,797,175 | A | | 8/1998 | Schneider |
| 5,797,237 | A | * | 8/1998 | Finkell, Jr. ..... 52/589.1 |
| 5,823,240 | A | | 10/1998 | Bolyard et al. |
| 5,827,592 | A | | 10/1998 | Van Gulik et al. |
| 5,860,267 | A | * | 1/1999 | Pervan ..... 52/748.1 |

5,935,668 A 8/1999 Smith
5,943,239 A 8/1999 Shamblin et al.
5,953,878 A 9/1999 Johnson
5,968,625 A 10/1999 Hudson
5,985,397 A 11/1999 Witt et al.
5,987,839 A 11/1999 Hamar et al.
6,006,486 A * 12/1999 Moriau et al. ..... 52/589.1
6,023,907 A 2/2000 Pervan
6,065,262 A 5/2000 Motta
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,168,866 B1 1/2001 Clark
6,182,410 B1 2/2001 Pervan
6,186,703 B1 2/2001 Shaw
6,205,639 B1 3/2001 Pervan
6,209,278 B1 4/2001 Tychsen
6,216,403 B1 4/2001 Belbeoc'h
6,216,409 B1 4/2001 Roy et al.
D442,296 S 5/2001 Külik
D442,297 S 5/2001 Külik
D442,298 S 5/2001 Külik
D442,706 S 5/2001 Külik
D442,707 S 5/2001 Külik
6,224,698 B1 5/2001 Endo
6,238,798 B1 5/2001 Kang et al.
6,247,285 B1 6/2001 Moebus
D449,119 S 10/2001 Külik
D449,391 S 10/2001 Külik
D449,392 S 10/2001 Külik
6,324,803 B1 12/2001 Pervan
6,345,481 B1 2/2002 Nelson
6,363,677 B1 4/2002 Chen et al.
6,397,547 B1 6/2002 Martensson
6,418,683 B1 7/2002 Martensson et al.
6,421,970 B1 7/2002 Martensson et al.
6,427,408 B1 8/2002 Krieger
6,436,159 B1 8/2002 Safta et al.
6,438,919 B1 8/2002 Knauseder
6,446,405 B1 9/2002 Pervan
6,449,913 B1 9/2002 Shelton
6,449,918 B1 9/2002 Nelson
6,453,632 B1 9/2002 Huang
6,458,232 B1 10/2002 Valentinsson
6,460,306 B1 10/2002 Nelson
6,461,636 B1 10/2002 Arth et al.
6,465,046 B1 10/2002 Hansson et al.
6,490,836 B1 12/2002 Moriau et al.
6,497,961 B2 12/2002 Kang et al.
6,505,452 B1 1/2003 Hannig et al.
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pålson et al.
6,546,691 B2 4/2003 Peopolder
6,553,724 B1 4/2003 Bigler
6,558,754 B1 5/2003 Velin et al.
6,565,919 B1 5/2003 Hansson et al.
6,569,272 B2 5/2003 Tychsen
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 9/2003 Chen et al.
6,635,174 B1 10/2003 Berg et al.
6,641,629 B2 11/2003 Safta et al.
6,646,088 B2 11/2003 Fan et al.
6,647,690 B1 11/2003 Martensson
6,649,687 B1 11/2003 Gheewala et al.
6,659,097 B1 12/2003 Houston
6,672,030 B2 1/2004 Schulte
6,675,545 B2 1/2004 Chen et al.
6,681,820 B2 1/2004 Olofsson
6,682,254 B1 1/2004 Olofsson et al.
6,685,993 B1 2/2004 Hansson et al.
6,711,864 B2 3/2004 Erwin
6,711,869 B2 3/2004 Tychsen
6,715,253 B2 4/2004 Pervan
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,786,019 B2 9/2004 Thiers
6,803,109 B2 10/2004 Qiu et al.
6,804,926 B1 10/2004 Eisermann
6,805,951 B2 10/2004 Kornfält et al.
6,823,638 B2 11/2004 Stanchfield
6,841,023 B2 1/2005 Mott
2001/0029720 A1 10/2001 Pervan
2001/0034992 A1 11/2001 Pletzer et al.
2002/0007608 A1 1/2002 Pervan
2002/0007609 A1 1/2002 Pervan
2002/0014047 A1 2/2002 Thiers
2002/0020127 A1 2/2002 Thiers et al.
2002/0046528 A1 4/2002 Pervan et al.
2002/0056245 A1 5/2002 Thiers
2002/0106439 A1 8/2002 Cappelle
2002/0112429 A1* 8/2002 Niese et al. ..... 52/392
2002/0160680 A1 10/2002 Laurence et al.
2002/0170258 A1 11/2002 Schwitte et al.
2002/0178681 A1* 12/2002 Zancai et al. ..... 52/592.1
2002/0178682 A1* 12/2002 Pervan ..... 52/592.1
2003/0024200 A1 2/2003 Moriau et al.
2003/0024201 A1 2/2003 Moriau et al.
2003/0029115 A1 2/2003 Moriau et al.
2003/0029116 A1* 2/2003 Moriau et al. ..... 52/592.1
2003/0029117 A1 2/2003 Moriau et al.
2003/0033777 A1 2/2003 Thiers et al.
2003/0033784 A1 2/2003 Pervan
2003/0037504 A1 2/2003 Schwitte et al.
2003/0066588 A1 4/2003 Palsson et al.
2003/0079820 A1 5/2003 Palsson et al.
2003/0093964 A1* 5/2003 Bushey et al. ..... 52/592.1
2003/0094230 A1 5/2003 Sjoberg
2003/0101681 A1 6/2003 Tychsen
2003/0115812 A1 6/2003 Pervan
2003/0115821 A1 6/2003 Pervan
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1* 12/2003 Pervan ..... 52/783.1
2003/1023380 * 12/2003 Pervan ..... 52/783.1
2004/0016196 A1 1/2004 Pervan
2004/0035078 A1 2/2004 Pervan
2004/0068954 A1* 4/2004 Martensson ..... 52/592.1
2004/0092006 A1 5/2004 Lindekens et al.
2004/0105994 A1 6/2004 Lu et al.
2004/0139678 A1 7/2004 Pervan
2004/0159066 A1 8/2004 Thiers et al.
2004/0177584 A1 9/2004 Pervan
2004/0200165 A1 10/2004 Garcia et al.
2004/0206036 A1 10/2004 Pervan

| | | | |
|---|---|---|---|
| 2004/0237447 | A1 | 12/2004 | Thiers et al. |
| 2004/0237448 | A1 | 12/2004 | Thiers et al. |
| 2004/0241374 | A1 | 12/2004 | Thiers et al. |
| 2004/0244322 | A1 | 12/2004 | Thiers et al. |
| 2004/0250493 | A1 | 12/2004 | Thiers et al. |
| 2004/0255541 | A1 | 12/2004 | Thiers et al. |
| 2004/0258907 | A1 | 12/2004 | Kornfalt et al. |
| 2005/0003149 | A1 | 1/2005 | Kornfalt et al. |
| 2005/0005559 | A1* | 1/2005 | Ralf ..... 52/589.1 |
| 2005/0016099 | A1 | 1/2005 | Thiers |

FOREIGN PATENT DOCUMENTS

| | | |
|---|---|---|
| AU | 713628 | 5/1998 |
| AU | 200020703 | 1/2000 |
| BE | 417526 | 9/1936 |
| BE | 557844 | 6/1957 |
| BE | 557844 | 3/1960 |
| BE | 09600527 | 6/1998 |
| BE | 09700344 | 10/1998 |
| CA | 991373 | 6/1976 |
| CA | 2226286 | 12/1997 |
| CA | 2252791 | 5/1999 |
| CA | 2289309 | 7/2000 |
| CH | 200949 | 1/1939 |
| CH | 211877 | 1/1941 |
| CH | 562377 | 5/1975 |
| DE | 314207 | 9/1919 |
| DE | 531989 | 8/1931 |
| DE | 740235 | 10/1943 |
| DE | 1089966 | 9/1960 |
| DE | 1534278 | 2/1966 |
| DE | 1212225 | 3/1966 |
| DE | 1212275 | 3/1966 |
| DE | 1534802 | 4/1970 |
| DE | 7102476 | 6/1971 |
| DE | 2007129 | 9/1971 |
| DE | 1534278 | 11/1971 |
| DE | 2252643 | 10/1972 |
| DE | 2238660 | 2/1974 |
| DE | 7402354 | 5/1974 |
| DE | 2502992 | 7/1976 |
| DE | 2616077 | 10/1977 |
| DE | 2917025 | 11/1980 |
| DE | 7911924 | 3/1981 |
| DE | 7928703 | 5/1981 |
| DE | 7928703 | 7/1981 |
| DE | 3041781 | 6/1982 |
| DE | 3214207 | 11/1982 |
| DE | 8226153 | 1/1983 |
| DE | 3343601 | 6/1985 |
| DE | 86040049 | 6/1986 |
| DE | 3512204 | 10/1986 |
| DE | 3246376 | 2/1987 |
| DE | 4004891 | 9/1990 |
| DE | 4002547 | 8/1991 |
| DE | 4134452 | 4/1993 |
| DE | 4215273 | 11/1993 |
| DE | 4242530 | 6/1994 |
| DE | 4011656 | 1/1995 |
| DE | 4324137 | 1/1995 |
| DE | 4107151 | 2/1995 |
| DE | 29517128 | 2/1996 |
| DE | 4242530 | 9/1996 |
| DE | 3544845 | 12/1996 |
| DE | 29710175 | 9/1997 |
| DE | 19616510 | 3/1998 |
| DE | 19651149 | 6/1998 |
| DE | 19709641 | 9/1998 |
| DE | 19718319 | 11/1998 |
| DE | 19735189 | 6/2000 |
| DE | 20001225 | 8/2000 |
| DE | 19925248 | 12/2000 |
| DE | 20017461 | 3/2001 |
| DE | 20018284 | 3/2001 |
| DE | 200 10 913 U1 | 4/2001 |
| DE | 20203311 | 6/2002 |
| DE | 20121196 | 7/2002 |
| DE | 20206460 | 8/2002 |
| DE | 102 24 540 A1 | 12/2003 |
| DE | 20218331 | 5/2004 |
| EP | 0248127 | 12/1987 |
| EP | 0623724 | 11/1994 |
| EP | 0652340 | 5/1995 |
| EP | 0667936 | 8/1995 |
| EP | 0690185 | 1/1996 |
| EP | 0849416 | 6/1998 |
| EP | 0698162 | 9/1998 |
| EP | 0903451 | 3/1999 |
| EP | 0855482 | 12/1999 |
| EP | 0877130 | 1/2000 |
| EP | 0969163 | 1/2000 |
| EP | 0969164 | 1/2000 |
| EP | 0974713 | 1/2000 |
| EP | 0843763 | 10/2000 |
| EP | 1200690 | 5/2002 |
| EP | 0958441 | 7/2003 |
| EP | 1026341 | 8/2003 |
| ES | 163421 | 9/1968 |
| ES | 460194 | 5/1978 |
| ES | 283331 | 5/1985 |
| ES | 1019585 | 12/1991 |
| ES | 1019585 | 4/1992 |
| ES | 2168045 | 5/2002 |
| FI | 843060 | 8/1984 |
| FR | 1293043 | 4/1962 |
| FR | 2691491 | 11/1983 |
| FR | 2568295 | 5/1986 |
| FR | 2623544 | 5/1989 |
| FR | 2630149 | 10/1989 |
| FR | 2637932 | 4/1990 |
| FR | 2675174 | 10/1991 |
| FR | 2667639 | 4/1992 |
| FR | 2691491 | 11/1993 |
| FR | 2697275 | 4/1994 |
| FR | 2712329 | 5/1995 |
| FR | 2776956 | 8/1999 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 812671 | 4/1959 |
| GB | 1033866 | 6/1966 |
| GB | 1034117 | 6/1966 |
| GB | 1044846 | 10/1966 |
| GB | 11237744 | 6/1968 |
| GB | 1127915 | 9/1968 |
| GB | 1275511 | 5/1972 |
| GB | 1399402 | 7/1975 |
| GB | 1430423 | 3/1976 |
| GB | 2117813 | 10/1983 |
| GB | 2126106 | 3/1984 |
| GB | 2152063 | 7/1985 |
| GB | 2238660 | 6/1991 |
| GB | 2243381 | 10/1991 |
| GB | 2256023 | 11/1992 |
| JP | 54-65528 | 5/1979 |
| JP | 57-119056 | 7/1982 |
| JP | 59-186336 | 10/1984 |
| JP | 3-169967 | 7/1991 |
| JP | 4-106264 | 4/1992 |
| JP | 5-148984 | 6/1993 |
| JP | 6-56310 | 5/1994 |
| JP | 6-146553 | 5/1994 |

| | | |
|---|---|---|
| JP | 6-200611 | 7/1994 |
| JP | 6-320510 | 11/1994 |
| JP | 7-76923 | 3/1995 |
| JP | 7-180333 | 7/1995 |
| JP | 7-300979 | 11/1995 |
| JP | 7-310426 | 11/1995 |
| JP | 8-109734 | 4/1996 |
| JP | 8-270193 | 10/1996 |
| NE | 7601773 | 2/1976 |
| NO | 157871 | 2/1988 |
| NO | 305614 | 6/1999 |
| RU | 363795 | 12/1972 |
| SE | 7114900-9 | 9/1974 |
| SE | 450141 | 6/1987 |
| SE | 450411 | 6/1987 |
| SE | 501014 | 10/1994 |
| SE | 501914 | 6/1995 |
| SE | 502994 | 4/1996 |
| SE | 506254 | 11/1997 |
| SE | 509059 | 11/1998 |
| SE | 509060 | 11/1998 |
| SE | 512290 | 2/2000 |
| SE | 512313 | 2/2000 |
| SE | 0000200-6 | 8/2001 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94/26999 | 11/1994 |
| WO | WO 94/26999 | 11/1994 |
| WO | 95/06176 | 3/1995 |
| WO | 96/27719 | 9/1996 |
| WO | 96/27721 | 9/1996 |
| WO | 96/30177 | 10/1996 |
| WO | 97/47834 | 12/1997 |
| WO | WO 9747834 A1 * | 12/1997 |
| WO | 98/24495 | 6/1998 |
| WO | 98/24994 | 6/1998 |
| WO | 98/38401 | 9/1998 |
| WO | WO 99/40273 | 8/1999 |
| WO | 99/66151 | 12/1999 |
| WO | WO 99/66152 | 12/1999 |
| WO | WO 00/06854 | 2/2000 |
| WO | WO 00/66856 | 11/2000 |
| WO | 01/02669 | 1/2001 |
| WO | 01/51732 | 7/2001 |
| WO | WO 01/66876 | 9/2001 |
| WO | 01/75247 | 10/2001 |
| WO | WO 01/75247 A1 | 10/2001 |

OTHER PUBLICATIONS

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

* cited by examiner

FLOOR PANEL

BACKGROUND OF THE INVENTION

1. Field of the Invention

The invention relates to a floor panel.

2. Background Description

WO 01/75247 A1 discloses a floor panel which, on a first side edge, has connecting means for locking in the transverse and vertical directions. These locking means are arranged on the longitudinal side of the panel and bring about locking by the connecting means being introduced and pivoted into a corresponding recess of a second panel. The transverse side of the panel has two snap-in hooks which, when the panels are laid, are intended to engage in corresponding undercuts of an adjacent panel and to hinder the vertical movement between the laid panels. The two snap-in hooks are located vertically one above the other.

The disadvantage with such a profile is the fact that such a profile configuration does not ensure that the panels are securely locked with one another since the snap-in hooks, which are arranged one above the other, are pressed in during the laying movement and, in the case of a resilient underlying surface, for example carpet, the transverse side springs out of the locking means when the panels are stepped on with force. This is also due to the fact that the panel provided with the snap-in hooks is angled slightly relative to the corresponding panel when stepped on, with the result that the panel twists out to some extent.

SUMMARY OF THE INVENTION

The object of the present invention is to provide a panel which allows straightforward laying and which ensures secure locking both in the transverse direction and in the vertical direction.

The object is achieved according to the invention by a floor panel having the features of claim 1. Advantageous configurations and developments of the invention are given in the dependent subclaims. By virtue of the rounded design of the underside of the tongue on the first side edge, it is particularly easy to pivot the panel into the corresponding groove of the already laid panel, the spacing apart of form-fitting elements in the transverse and vertical directions providing two spatially separate locking locations on the second side edge. This second side edge is advantageously arranged on the transverse side, and the spatially separated locking locations ensure that the panels, which have been positioned against one another and laid, are better secured.

A development of the invention provides that the radius of curvature of the contour of the underside of the tongue remains essentially constant over at least 90°, with the result that a uniform pivoting-in movement and a straightforward sliding action on the corresponding recess can take place.

A development provides that a step-like milled relief with a shoulder which projects in the direction of the underside is formed on the second side edge, the shoulder having an essentially horizontally oriented head surface in which is incorporated a channel which is oriented along the longitudinal extent of the second side edge. This channel creates a dust pocket in which dirt or abraded material which is produced during laying of the panels may be enclosed without this adversely affecting the laying accuracy. The channel, furthermore, gives rise to a slight spring effect, with the result that the locking on the second side edge is subjected to a certain amount of prestressing.

BRIEF DESCRIPTION OF THE DRAWINGS

An exemplary embodiment of the invention will be described hereinbelow with reference to the attached figures, in which the same designations are used to designate the same objects and in which.

DETAILED DESCRIPTION OF EMBODIMENTS OF THE INVENTION

Figure 1:
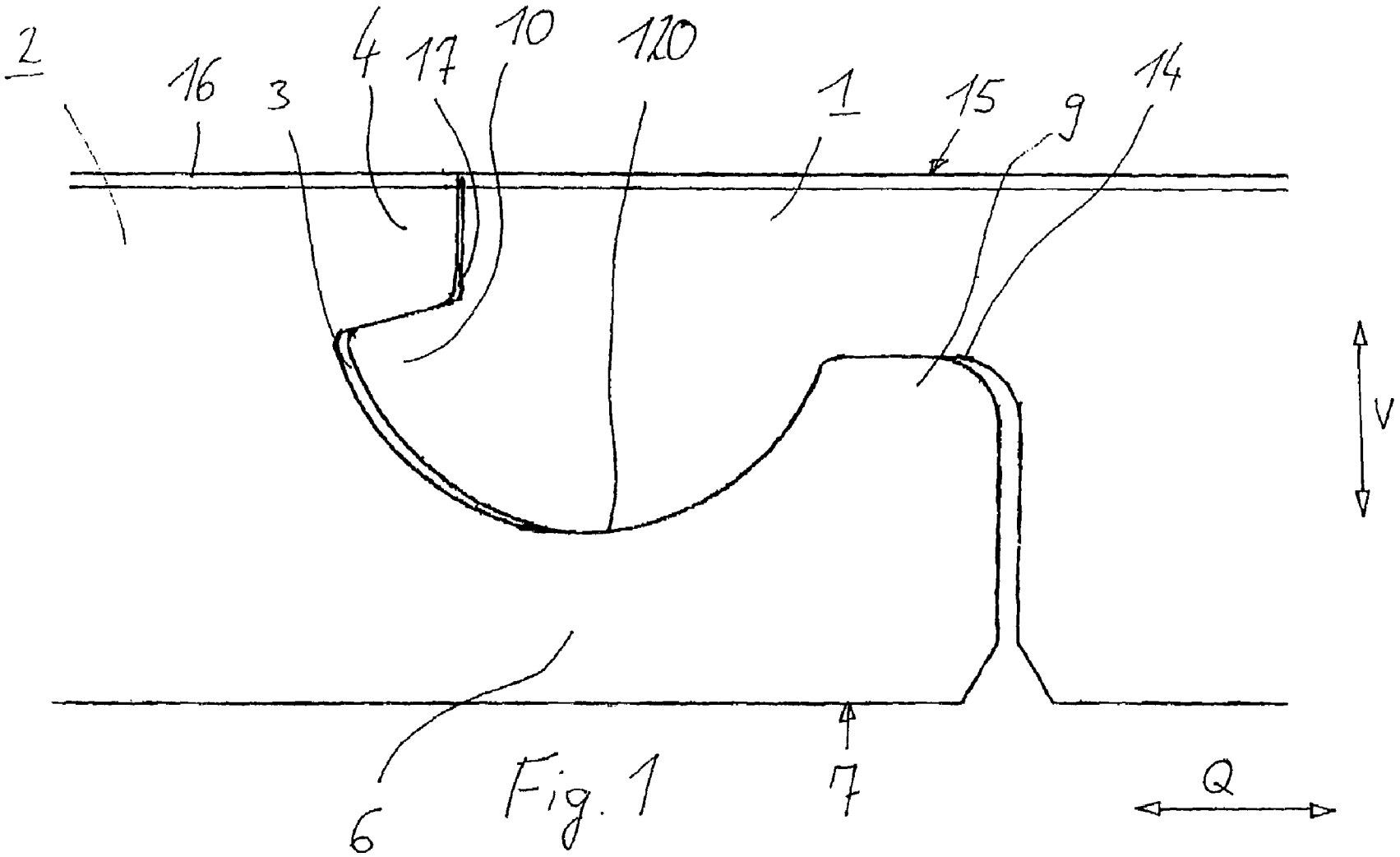
FIG. 1 shows a partial cross section of two interconnected panels at the connecting location.

FIG. 1 shows a floor panel 1 which comprises a medium-density or high-density fiberboard (MDF or HDF), which is locked with a second floor panel 2. On their top side 15, the floor panels 1, 2 are provided with a decorative layer 16 which may be formed, for example, by a paper layer which exhibits a woodgrain and is coated with a synthetic-resin layer serving to protect against wear. A sound-insulation layer may be adhesively bonded to the underside in order to improve the footfall-sound properties of the laid floor panels 1, 2. As an alternative to using an HDF or MDF board, the panel may be produced from an OSB material.

The panel 1 is provided with a tongue 10 on a first side edge, preferably on the longitudinal side of the panel, and with a correspondingly designed groove 3 on the opposite side. The groove 3 and the tongue 10 run over the entire length of the side edge. Provided on the tongue 10 is an outwardly projecting, rounded nose, which is adjoined by the underside 120 of the tongue 10 with a rounded contour. The radius of this contour is constant over at least 90 degrees and thus allows the tongue 10 to slide easily into the groove 3.

In the installed state, the tongue 10 engages in an undercut formed by the top lip 4 of the groove 3, with the result that locking takes place in the vertical direction V along the first edge. The locking in the transverse direction Q takes place by virtue of the underside 120 of the tongue 10 butting in a form-fitting manner against a shoulder 9, which terminates the groove 3. Formed on the top side of the shoulder 9 is a horizontally running surface which serves as a support for a bearing region 14.

The operations of laying and locking two panels 1, 2 with such a profile take place by virtue of the first panel 1 being positioned with the tongue 10 at an angle to the second panel 2 and by the tongue 10 being introduced into the groove 3 of the second panel 2. The angled first panel 1 is then pivoted about an axis parallel to the longitudinal direction of the first side edge, in the present case in the clockwise direction, with the result that the round contour of the underside 120 of the tongue 10 slides along in the groove 3 until the bearing region 14 rests in a planar manner on the shoulder 9. In this state, the undercut of the top lip 4 and also the shoulder 9 result in effective locking in the vertical direction V and transverse direction Q.

Figure 2:
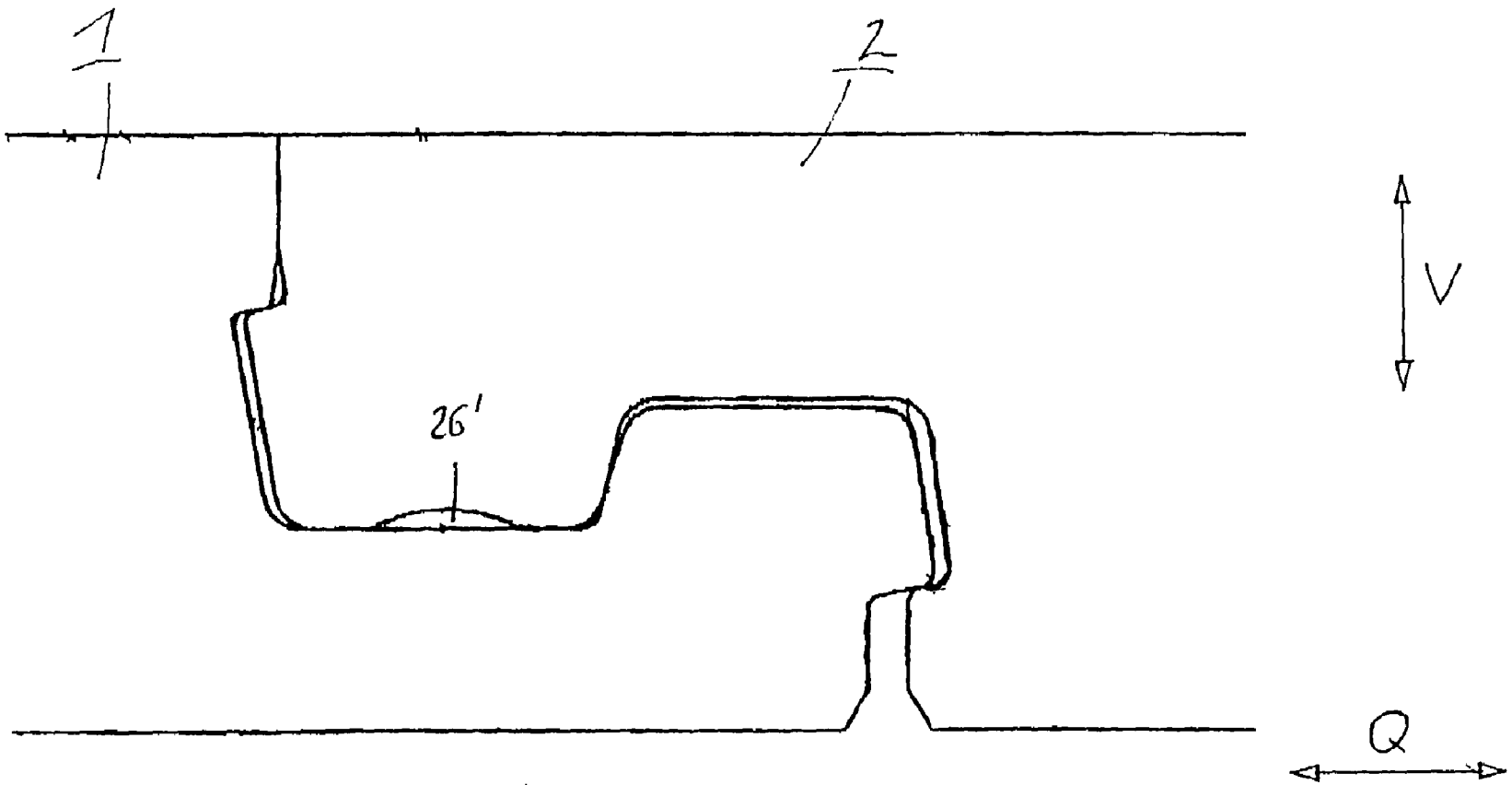
FIG. 2 shows a partial cross section of two interconnected panels at a second connecting location.

In order to allow locking with another panel not just on two opposite side edges of a panel, a profile which is illustrated in FIG. 2 is formed on a second edge, which runs preferably at right angles to the first edge. Here too, corresponding profiles are formed on opposite side edges, as can be gathered from FIG. 2.

Figure 3:
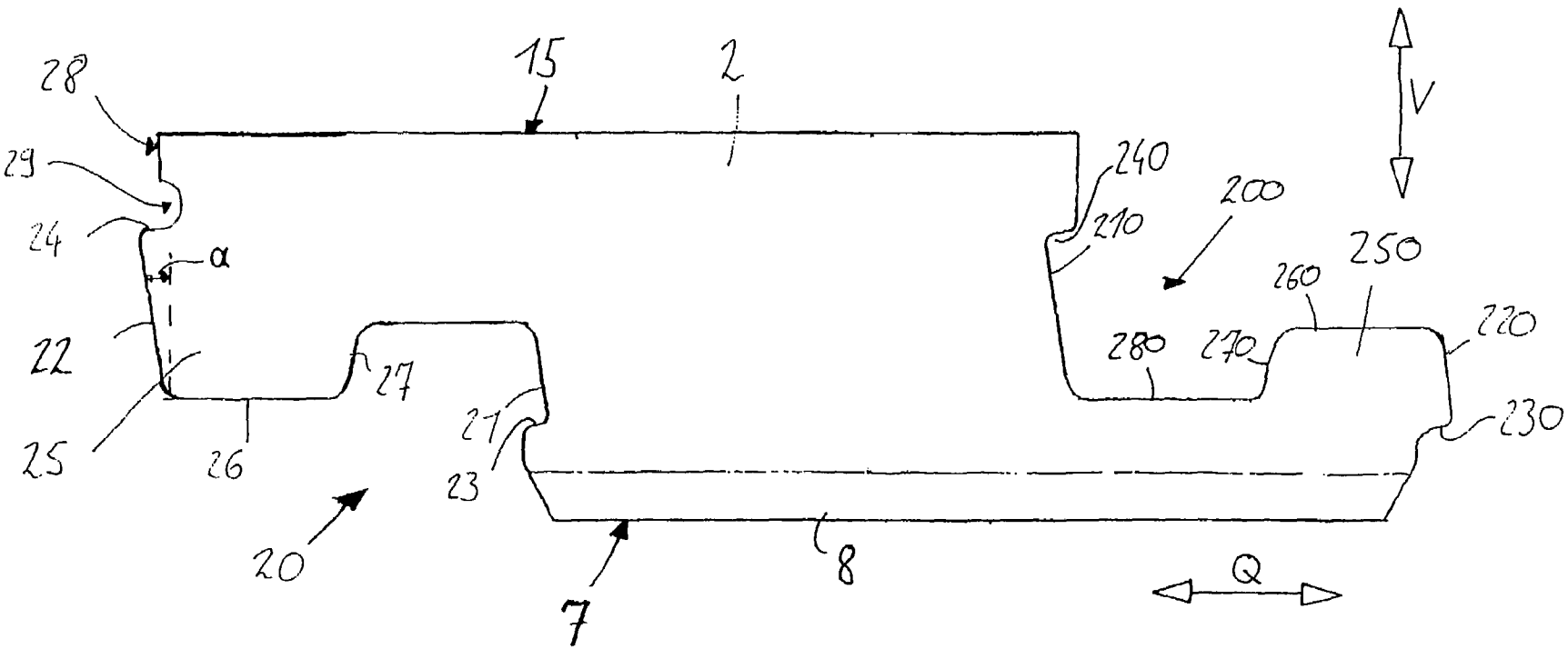
FIG. 3 shows a cross-sectional view of a floor panel with a second side edge.

FIG. 3 shows such a profile on a second side edge in cross section, this preferably being formed on the transverse side of the panel. A step-like milled relief 20 is made in the panel 2, starting from the underside 7, and forms an inner wall 21 and an outer wall 22. Form-fitting elements 23, 24 are formed on, in this case milled out of, the inner wall 21 and the outer wall 22, said elements engaging, in the form of protrusions, in corresponding undercuts 230, 240 of a corresponding recess 200 of a second panel 1. A shoulder 25 is formed in the milled relief 20 and projects in the direction of the underside 7, the outer shoulder wall being formed by the outer wall 22 and the inner shoulder wall 27, in the exemplary embodiment illustrated, forming an upwardly widening cross section. The underside of the shoulder 25 forms a head surface 26 which runs parallel to the top side 15 of the panel 2 and on which the panel 2 is supported, in the installed state, via a corresponding base surface 280 of a corresponding recess 200 of a second panel 1.

As an alternative to the embodiment illustrated, it is provided that the inner surface 27 runs essentially parallel to the outer wall 22, with the result that the inner shoulder wall 27 forms an undercut in relation to the head surface 26. Provision is likewise made for the outer wall 22, in addition to being designed essentially rectilinearly at an acute angle $\alpha$ to the vertical, to be rounded or to run vertically. It is necessary here for the form-fitting element 24 to project beyond the termination edge 28 of the top side 15, in order to carry out form-fitting locking with the second panel.

A recess 29 is formed above the form-fitting element 24 and acts as a dust pocket.

If the inner shoulder wall 27 is designed as an undercut in relation to the head surface 26, additional vertical locking is provided, in particular if the corresponding inner shoulder wall 270 of the upwardly directed shoulder 250 is likewise designed as an undercut. Form-fitting locking then takes place by the profiles being bent up slightly or elastically deformed, with the result that the form-fitting elements 23, 24 and the undercut provided by the inner shoulder wall 27 can pass into effective engagement with the corresponding undercuts 230, 240 and the undercut provided by the inner shoulder wall 270.

The milled relief 200, which starts from the top side 15, is designed such that it can accommodate the opposite profile, with the result that, on the one hand, the head surface 26 rests in a completely planar manner on the base surface 280 and, on the other hand, the surfaces 15 of the two panels 1, 2 in the installed state, as is illustrated in FIG. 2, terminate in a single plane and are positioned, as far as possible, flush one against the other. The recess 29 above the form-filling element 24 creates a free space 290 which serves as a dust pocket, and the same applies to the free space 300, which is formed by corresponding positioning of the inner wall 210 of the milled relief 200.

As can clearly be seen in FIG. 2, effective locking is provided both in the transverse direction Q and in the vertical direction V, the locking in the transverse direction Q being realized with form-fitting action by the shoulders 25, 250. Locking in the vertical direction V takes place by way of the locking elements 23, 24, which engage with form-fitting action in the undercuts 230, 240, the form-fitting elements 23, 24 being arranged on spaced-apart walls 21, 22. Furthermore, the form-fitting elements 23, 24 are arranged on different vertical levels, this resulting in the formation of a top locking point and a bottom locking point. The top locking point is formed by the form-fitting element 24 and the undercut 240, and the bottom locking point is formed by the form-fitting element 23 and the undercut 230.

The upwardly directed shoulder 250, rather than being formed over the entire length of the second side edge, is milled off down to the base surface 280, this milling being provided in the direction of the first side edge with a tongue 10. By virtue of this milling out or non-formation of the shoulder 250, it is possible, during laying of the panels, for the initially angled panel to be lowered further downward before an abrupt installation movement in the downward direction gives rise to definitive locking via the second side edge, preferably the transverse side.

In the installed state, there is a free space between the head surface 260 of the shoulder 250 and the corresponding surface of the milled relief 20, this free space being necessary in order that the form-fitting element 23 can engage behind the undercut 230. This free space likewise serves as a dust pocket.

It can also clearly be seen in FIG. 2 that a channel 26' is formed in the head surface 26 of the shoulder 25, this channel extending over the entire length of the side edge. The channel 26' serves as a dust pocket and as a material-weakening means, with the result that there is a certain spring effect when the two panels 1, 2 are locked.

The invention claimed is:

1. A floor panel which is bounded in a horizontal plane by a top side having a decorative layer, and an underside provided for bearing on an underlying surface, the floor panel being provided with means for releasably connecting at least two panels, wherein the connecting means are formed on at least one first side edge such that locking takes place in a transverse direction (Q) and vertical direction (V), and further comprising form-fitting elements for locking in the vertical direction (V) with a further panel formed on a second side edge running at an angle to the first side edge, wherein the form-fitting elements are spaced apart from one another in the transverse direction (Q) and in the vertical direction (V) on two spaced-apart, essentially vertically oriented walls, and further comprising a tongue formed on the first side edge and extending in the longitudinal direction of the first side edge, and a recess corresponding to the tongue formed on an opposite side edge, wherein an underside of the tongue, starting from a tip of the tongue, has a continuously curved contour and wherein a radius of curvature of the contour of the underside of the tongue is constant over at least 90 degrees;

the floor panel further comprising a first step-like milled relief formed on the second side edge and starting from the underside, wherein the first step-like milled relief includes an inner wall on which one said form-fitting element extending in the transverse direction (Q) is arranged and an outer wall on which an other said form-fitting element extending in the transverse direction (Q) is arranged, and further comprising a second step-like milled relief formed on a side edge that is located opposite the second side edge, wherein the second step-like milled relief starts from the top side and has an other inner wall and an other outer wall, on which are formed undercuts which correspond with the one and the other form-fitting elements, wherein the first step-like milled relief forms a shoulder which projects in a direction of the underside and has an essentially horizontally oriented head surface, and further comprising a channel formed in the head surface along a longitudinal extent in relation to the second side edge.

2. The floor panel according to claim 1, wherein the recess is designed as a groove with a top lip and a bottom lip, in which the tongue can be latched in the transverse direction (Q).

3. A floor panel which is bounded in a horizontal plane by a top side having a decorative layer, and an underside provided for bearing on an underlying surface, the floor panel being provided with means for releasably connecting at least two panels, wherein the connecting means are formed on at least one first side edge such that locking takes place in a transverse direction (Q) and vertical direction (V), and further comprising form-fitting elements for locking in the vertical direction (V) with a further panel formed on a second side edge running at an angle to the first side edge, wherein the form-fitting elements are spaced apart from one another in the transverse direction (Q) and in the vertical direction (V) on two spaced-apart, essentially vertically oriented walls, and further comprising a tongue formed on the first side edge and extending in the longitudinal direction of the first side edge, and a recess corresponding to the tongue formed on an opposite side edge, wherein an underside of the tongue, starting from a tip of the tongue, has a continuously curved contour and wherein a radius of curvature of the contour of the underside of the tongue is constant over at least 90 degrees, wherein walls forming at least a portion of the tongue and groove, respectively, are sized and shaped to form a dust pocket.

4. A floor panel, comprising:

a top side;

an underside for bearing on an underlying surface;

a first side edge having a tongue;

an opposite side edge having a recess corresponding to the tongue; and a second side edge extending in a transverse direction to the first side edge and having form-fitting elements for locking in a vertical direction with a further panel, wherein the form-fitting elements are spaced apart from one another in the vertical direction and the transverse direction, the second side edge includes a first step-like milled relief starting from the underside and having an essentially vertical inner wall and an essentially vertical outer wall, wherein one said form-fitting element is formed on the inner wall and an other said form-fitting element is formed on the outer wall, and the first step-like milled relief includes an essentially horizontal head surface with a channel formed therein.

5. The floor panel of claim 4, wherein an underside of the tongue has a radius of curvature that is constant over at least 90 degrees.

6. The floor panel of claim 4, wherein the recess is formed as a groove with a top lip and a bottom lip, in which the tongue of another floor panel can be latched in the transverse direction.

7. The floor panel of claim 4, further comprising a side edge opposite the second side edge having a second step-like milled relief and having spaced apart undercuts which correspond to the form-fitting elements.

8. The floor panel of claim 4, wherein walls forming at least a portion of the tongue and recess, respectively, are sized and shaped to form a dust pocket.

* * * * *